US009597719B2

(12) United States Patent
Poloni et al.

(10) Patent No.: US 9,597,719 B2
(45) Date of Patent: Mar. 21, 2017

(54) DEVICE AND METHOD FOR REMOVAL OF SCALE FROM A METAL PRODUCT

(75) Inventors: Alfredo Poloni, Fogliano di Redipuglia (IT); Matteo Nobile, Ruda (IT); Paolo Ragogna, Brugnera (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 539 days.

(21) Appl. No.: 14/129,738

(22) PCT Filed: Jun. 28, 2012

(86) PCT No.: PCT/IB2012/001293
§ 371 (c)(1),
(2), (4) Date: Apr. 24, 2014

(87) PCT Pub. No.: WO2013/001350
PCT Pub. Date: Jan. 3, 2013

(65) Prior Publication Data

US 2014/0283883 A1 Sep. 25, 2014

(30) Foreign Application Priority Data

Jun. 30, 2011 (IT) ..... UD2011A0101

(51) Int. Cl.
*B08B 3/04* (2006.01)
*B21B 45/04* (2006.01)
(Continued)

(52) U.S. Cl.
CPC ..... *B21B 45/04* (2013.01); *B21B 45/08* (2013.01); *B08B 3/00* (2013.01); *B08B 3/02* (2013.01);
(Continued)

(58) Field of Classification Search
CPC .. B08B 3/00; B08B 3/02; B08B 3/028; B08B 3/04; B21B 45/04; B21B 45/08; B21B 45/0233
See application file for complete search history.

(56) References Cited

U.S. PATENT DOCUMENTS 2,921,748 A 1/1960 Kane
2007/0234951 A1* 10/2007 Lu ..... B08B 3/024 118/300
2015/0217336 A1* 8/2015 Seidel ..... B21B 45/0233 134/15

FOREIGN PATENT DOCUMENTS

EP 0838551 A1 4/1998
JP S64-11012 A 1/1989
(Continued)

OTHER PUBLICATIONS

Int'l Search Report issued Dec. 17, 2012 in Int'l Application No. PCT/IB2012/001293.
(Continued)

*Primary Examiner* — Bibi Carrillo
(74) *Attorney, Agent, or Firm* — Panitch Schwarze Belisario & Nadel LLP

(57) ABSTRACT

Device for the removal of scale from the surface of a metal product (11) by delivering water under pressure, said device comprising a box-like structure (20) defining an internal space (22) for the passage of the water under pressure, connected to an exit fissure having a gap (23) with a gap value of less than a millimeter, the gap extending continuously for at least the entire width of the metal product (11).

8 Claims, 3 Drawing Sheets

(51) Int. Cl.

| | |
|---|---|
| ***B21B 45/08*** | (2006.01) |
| *B08B 3/02* | (2006.01) |
| *B08B 3/00* | (2006.01) |
| *B21B 45/02* | (2006.01) |

(52) U.S. Cl.
CPC ..... *B08B 3/028* (2013.01); *B08B 3/04* (2013.01); *B21B 45/0233* (2013.01)

(56) References Cited

FOREIGN PATENT DOCUMENTS

| | | | |
|---|---|---|---|
| JP | H07-204561 | A | 8/1995 |
| JP | 2010-172838 | A | 8/2010 |
| SU | 624676 | A1 | 8/1978 |

OTHER PUBLICATIONS

Written Opinion issued Dec. 17, 2012 in Int'l Application No. PCT/IB2012/001293.
Int'l Preliminary Report on Patentability issued Jun. 11, 2013 in Int'l Application No. PCT/IB2012/001293.

* cited by examiner

DEVICE AND METHOD FOR REMOVAL OF SCALE FROM A METAL PRODUCT

CROSS REFERENCE TO RELATED APPLICATION

This application is a Section 371 of International Application No. PCT/IB2012/001293, filed Jun. 28, 2012, which was published in the English language on Jan. 3, 2013, under International Publication No. WO 2013/001350 A2, and the disclosure of which is incorporated herein by reference.

FIELD OF THE INVENTION

The present invention concerns a device and a method to remove scale from a metal product.

The present invention is applied in particular, but not only, in a rolling line for flat products and, even more particularly in association with reversing rolling stands, such as those used in Steckel rolling mills.

However, it must be understood that the present invention can also be applied in association with continuous train rolling lines, individual roughing or finishing stands, and substantially in every type of working of a metal product that requires an efficient removal of the scale present on the surface of the metal product.

BACKGROUND OF THE INVENTION

In the hot rolling of metal products, in particular flat products such as strip or sheet, it is known that it is necessary to provide, for example at exit from the heating and/or maintenance systems, devices suitable to remove the surface scale generated due to the exposure to the atmosphere of the metal product at high temperature.

Known scale-removal systems are substantially divided into mechanical, chemical or chemical-mechanical methods depending on how they are achieved.

Among the mechanical methods, it is known for example to strike the surface of the material to be cleaned, in movement, with solid particles having a desired hardness and shape, which are thrown at high speed against the surface to be cleaned.

Depending on the desired result and the type of material to be treated, the solid particles consist of cast iron or steel balls; alternatively, steel brushes rotating at high speed can be used.

In rolling lines on the contrary it is known to use generally a method to remove the scale using jets of water at high pressure, which are directed with a suitable inclination onto the moving metal product.

In this method, the moving metal product is hit, both below and above, by jets of water at a pressure between around 10-18 MPa.

Known devices that carry out this method normally use nozzles—fixed, rotating and/or translating—which emit the jet of water toward the surface of the metal product, operating on the physical principle of heat shock, to which the scale is subjected on contact with the water, which causes it to detach from the surface of the product and to be consequently removed.

However, it has been found that this method, which uses jets of pressurized water emitted from nozzles, is not suitable to remove the scale when the thickness of the metal product goes below a certain value (for example ≤4-5 mm), since the jets of water emitted by the nozzles cause an excessive cooling of the product, which therefore comes out from the scale-removal device too cold, making the subsequent rolling pressures thereof increase excessively.

To prevent the product cooling, the pressure and hence the flow rate of the scale-removal water should be reduced, but if scale remains on the surface of the product, in the subsequent rolling step the scale becomes deeply impressed in said surface, and therefore the quality of the final product obtained deteriorates.

This entails a considerable economic damage, since the resultant final product is lower quality and hence a lower sales price is given to it.

If this problem is not particularly important in continuous train rolling mills, since the scale is removed at entrance to the first stand in the train when the thickness of the strip is still sufficiently high (for example ≥10-12 mm), and the scale does not have time to reform in the short inter-stand segments, on the contrary it is very important in Steckel reversing rolling mills.

In this type of stands a rolled product passes several times in one direction and the other through one or two reversing stands, reducing in thickness at every pass, and winding inside a winding/unwinding furnace after each pass.

To prepare the strip for rolling, between the winding/unwinding furnace and the reversing stand a scale-removal device may by provided.

As we said before, however, when the thickness of the strip goes below a certain value, for example less than 8 mm, or even more if less than 5 mm, the scale-removal device must be de-activated, since the action of the jets of water emitted by the nozzles would cause an excessive cooling of the surface of the strip such as to render the subsequent rolling pressure excessive.

This problem has until now limited the potential of reversing mills, in practice preventing the use of scale-removal devices for very thin products, for example 1.5-3 mm.

U.S. Pat. No. 2,921,748 and SU-A1-624.676 describe scale-removal devices comprising nozzles associated with a box-like structure having a fissure for the water to exit which extends for the width of the metal product.

The purpose of the invention is therefore to obtain a device, and the corresponding method, to totally remove the scale, and to contain the loss of temperature of the surface of the strip in the rolling step, also on products with a very thin thickness (for example ≤5 mm), so as not to create problems in the subsequent rolling steps.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the invention or variants to the main inventive idea.

According to the present invention, a scale-removal device comprises at least a device to deliver a high-pressure blade of water through an exit fissure, which terminates in a gap through which the water is discharged. As used herein, the "gap value" of the gap is the distance between the surfaces that form the gap. The gap value is less than one millimeter, in particular less than some tenths of a millimeter, more preferably comprised between 1 and 10 hundredths of a millimeter.

Here and hereafter in the description, when we speak of water we mean any liquid suitable to perform the function of removing scale, for example water mixed with an additive or other. It is also understood that a characterizing feature of the present invention, in relation to the extremely limited size of the gap, is the use of water or other suitable liquid that is extremely clean and/or has been subjected to filtering and cleaning treatments, preferably on delivery, in order to prevent even the minimum partial blockage of the gap.

The scale-removal device according to the present invention is positioned in cooperation with a surface of the metal product to be treated, so that the distance between the exit fissure and said surface is advantageously comprised between 10 and 30 millimeters.

According to one feature of the present invention, mechanisms are provided to adjust, also automatically, the position of the device with respect to the product to be treated, in order to keep the delivery distance at a predetermined or predeterminable value, even as the thickness of the product varies, which product, for example in a reversing stand of a Steckel rolling mill, is reduced after every pass.

The exit fissure has a delivery front, or width, which is greater than the width of the product to be treated, so as not only to cover the entire width of the product, thus guaranteeing a substantially uniform treatment of the entire surface, but also to protrude from both sides by a certain margin, so as to guarantee that a predetermined gap value is controlled and correct, as explained hereafter.

According to one form of embodiment of the present invention, the device comprises a box-like structure, preferably metal, that develops in width with a size, as we said, greater than the width of the product to be treated, on a perimeter part of which the water delivery element is made.

In one form of embodiment, the water delivery element consists of a pair of tiles, advantageously replaceable, which are suitably shaped so as to face each other to define the exit fissure with the gap at the end.

According to one feature of the present invention, automated means are provided, associated with the box-like structure of the device, and configured to guarantee that the gap value of the exit fissure is kept at a predetermined value.

The problem of adjusting the gap value of the gap of the exit fissure is extremely important since the water blade that removes the scale must be as homogeneous as possible along the whole extension in width of the product treated. This is to prevent some zones of the product from being hit by a larger quantity of water and are consequently cooled more, thus compromising the final quality of the product.

In one formulation of the present invention, the automated means comprise at least a position detector device associated with a control unit, and at least an actuator, which is associated with a structural component of the device and is configured to be selectively activated according to the commands of the control unit upon reception of the signals detected by the detector device.

In one formulation of the present invention, the structural component of the device is a connection and stiffening tie-rod, which develops in a direction substantially orthogonal to the development of the device and, when stressed by the corresponding actuator, determines a correction of the gap value of the gap of the exit fissure.

According to a variant, the box-like structure of the device comprises a plurality of the tie-rods, advantageously equidistant, in order to distribute the adjustment of the gap value uniformly and to ensure it is kept substantially equal over its whole width.

In another form of embodiment of the present invention, the tie-rod/s can be selectively used to widen the gap of the exit fissure (increase the gap value) of the device in order to carry out a process of cleaning the exit fissure of any possible impurities that could block or deform the thickness of the blade of water; the process could be carried out when the device is not in use.

In one formulation of the invention, an initial setting procedure is provided so that all the transducers work in the same conditions; the procedure provides the following steps:

- the transducers are activated by an equal force, completely closing the exit fissure;
- a pressure is introduced inside the device, equal to the pressure of the descaling water;
- all the transducers are zeroed, thus obtaining a same reference and the same behavior during functioning.

In another formulation of the invention, during use, a function is set to adjust the tie-rods so as to progressively reduce, at predetermined time intervals, the value of the gap of the exit fissure so as to restore the gap following wear on the edge of the exit fissure, caused by the microparticles that are transported at high speed together with the water used to remove the scale. In this way, it is possible to keep the value of the width of the exit fissure substantially constant as the operating cycles of the scale-removal device proceed.

In another formulation, the width of the exit fissure is measured at several points, and possibly corrected point-by-point and selectively, adjusting one or more of the respective tie-rods; this procedure allows to restore possible deformations caused for example by lack of uniformity in the rigidity of the structure, which can generate, during use, differentiated deformations on the width of the device, or caused by differentiated effects of abrasion due to the particles transported by the water, which can cause differentiated wear on the width of the exit fissure.

According to one formulation of the present invention, the angle of inclination of the blade of water is adjustable between a value of zero with respect to the vertical to the surface of the product, and a value of about 20°, advantageously comprised between 5° and 15° in a direction contrary to the direction of feed of the product to be treated.

The use of a device having the characteristics described above allows to deliver a jet of water having a constant thickness and a conformation of the blade that is uniform over the whole width of the product to be descaled. The blade of water impacts on the surface of the strip at extremely high speed (for example from 4÷10 m/s) and removes the scale without causing the scale to break due to thermal shock, but due to mechanical removal, given the high kinetic energy with which it impacts the surface.

In other words, due to the configuration and activation parameters of the device described above, the jet of water removes the layer of scale present on the surface of the product without affecting the surface of the product under the scale, except for a minimum fraction of time (measured by the Applicant as about 0.00010 seconds). In this way we obtain that the reduction in temperature of the metal product to be descaled is extremely limited, allowing to treat in this way metal products even with very small thicknesses, less than 8 millimeters, or even less than 5 millimeters, as thin as 2 millimeters, without causing excessive reductions in temperature such as would compromise the subsequent rolling.

According to the present invention, the pressure values used are at least 75 bar, advantageously in the range of 100-150 bar, to ensure an exit speed of the jet of water of at least 100-150 m/s.

In one formulation of the invention, the value of the water flow rate is correlated to the acceleration ramp of the product to be treated, growing in coordination with the increase in speed of the strip.

If there are two devices present, one for each surface of the product to be treated, they may be aligned with each other (one above the other) or longitudinally offset.

If they are aligned, the respective delivery pressures can be different, for example the pressure of the device above can be slightly greater, so as to make the strip rest on rolls located laterally and to stabilize the development of the product to prevent unwanted jolting.

If they are offset, respective stabilizing and contrasting rolls may be provided on the opposite side.

BRIEF DESCRIPTION OF THE DRAWINGS

These and other characteristics of the present invention will become apparent from the following description of a preferential form of embodiment, given as a non-restrictive example with reference to the attached drawings wherein.

DESCRIPTION OF A PREFERENTIAL FORM OF EMBODIMENT

Figure 1:
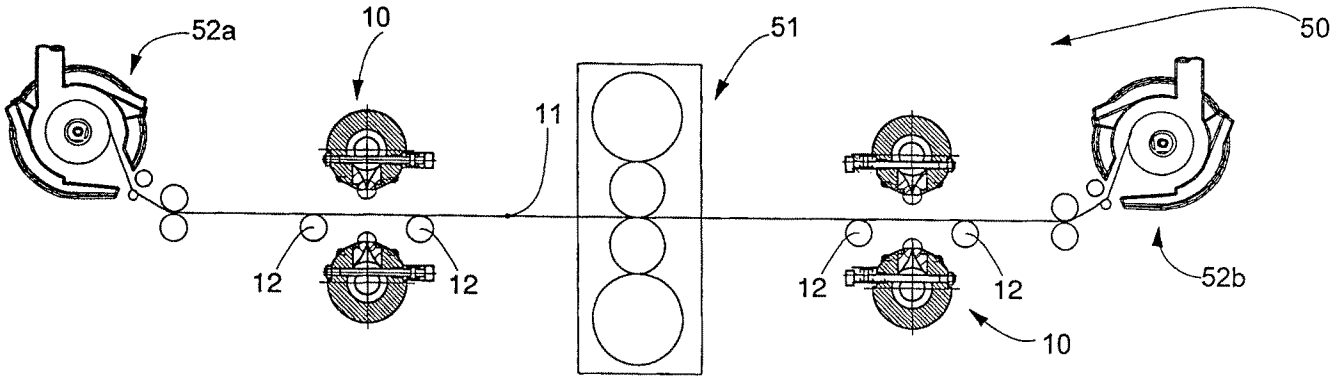
FIG. 1 shows a possible application of the present invention to a rolling line with a Steckel reversing rolling mill.

With reference to the attached drawings, FIG. 1 shows one form of embodiment of a Steckel reversing rolling mill 50 for flat rolled products 11 where the scale-removal device 10 according to the present invention is preferably applied.

The rolling mill 50 comprises, in a known manner, a reversing rolling stand 51, a winding/unwinding furnace 52*a* located upstream and a winding/unwinding furnace 52*b* located downstream of the reversing stand 51.

Between the furnaces 52*a*, 52*b* and the stand 51 there are scale-removal devices 10 according to the present invention, in this case one for each face of the product 11.

Figure 2:
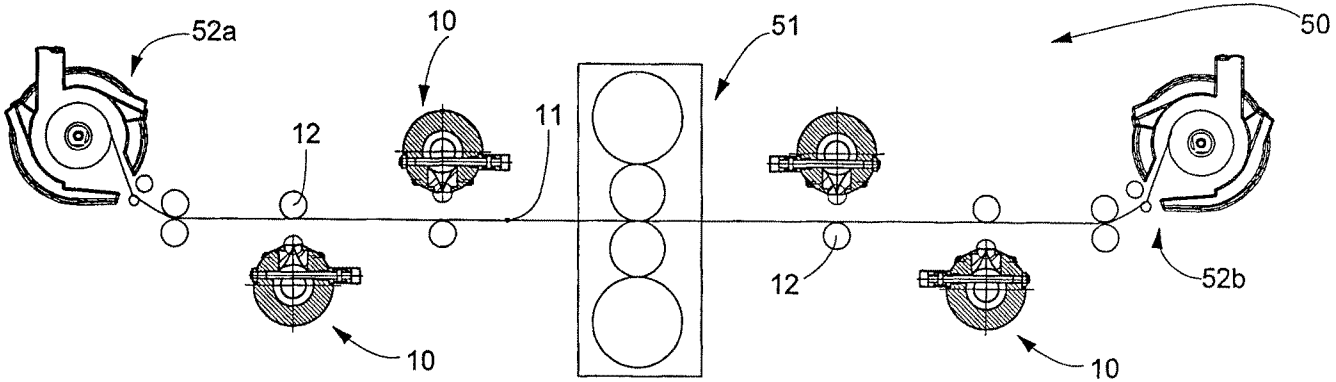
FIG. 2 is a variant of FIG. 1.
Figure 3:
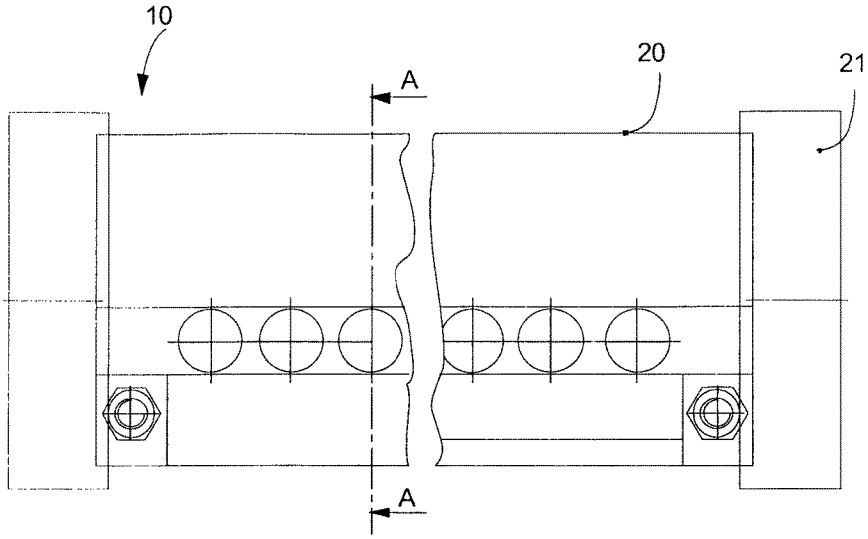
FIG. 3 is a front view of the scale-removal device according to the present invention.

In the solution shown in FIG. 1, the devices 10 are facing each other, while in the solution shown in FIG. 2 they are longitudinally offset and cooperate on the opposite side of the rolled product 11 with a respective contrasting roll 12. In the case of FIG. 1, laterally to the device 10 there are support rolls 12 in which the strip can be stabilized, in particular if the delivery pressures of the devices are different from each other.

The device 10 comprises a box-like containing structure 20 which, in this case, has a substantially cylindrical section shape. It comes within the field of the present invention that the structure may have a polygonal shape, for example square, rectangular, hexagonal etc., or also oval, or any other suitable shape.

On the heads of the box-like structure 20 there are flanges 21 by means of which a device to feed the water can be connected with the desired parameters of pressure and flow rate.

The water, fed through the heads 25, in the directions indicated by the arrows, passes through the internal space 22 of the box-like structure 20 to be made to exit through an exit fissure and a gap 23 defined by the adjacent surfaces of two tiles 24, appropriately shaped.

The tiles 24 have a suitably rounded shape so as to accompany and facilitate the exit of the water from the exit fissure and the gap 23, without creating slowdowns or obstacles in the path.

Figure 4:
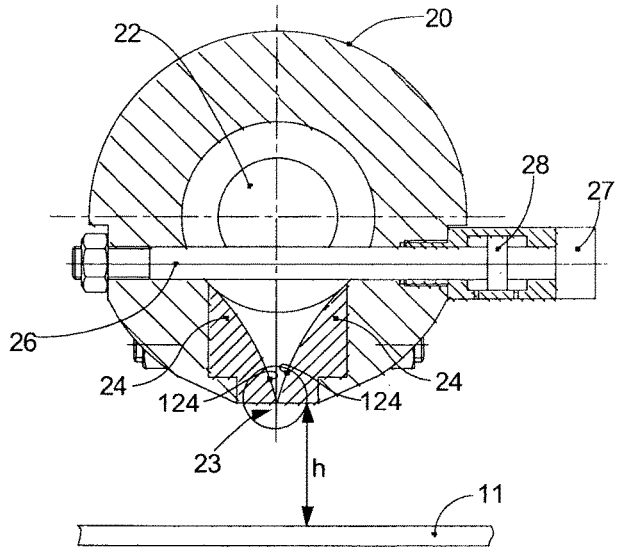
FIG. 4 is a section from A to A of FIG. 3.
Figure 4A:
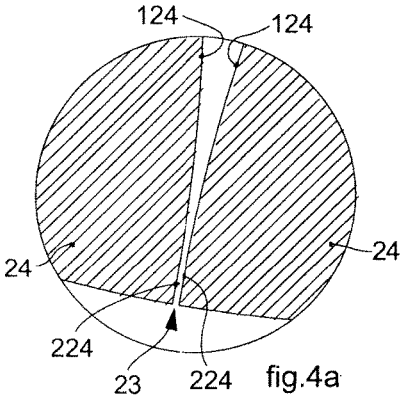
FIG. 4*a* shows an enlarged detail of FIG. 4.
Figure 5:
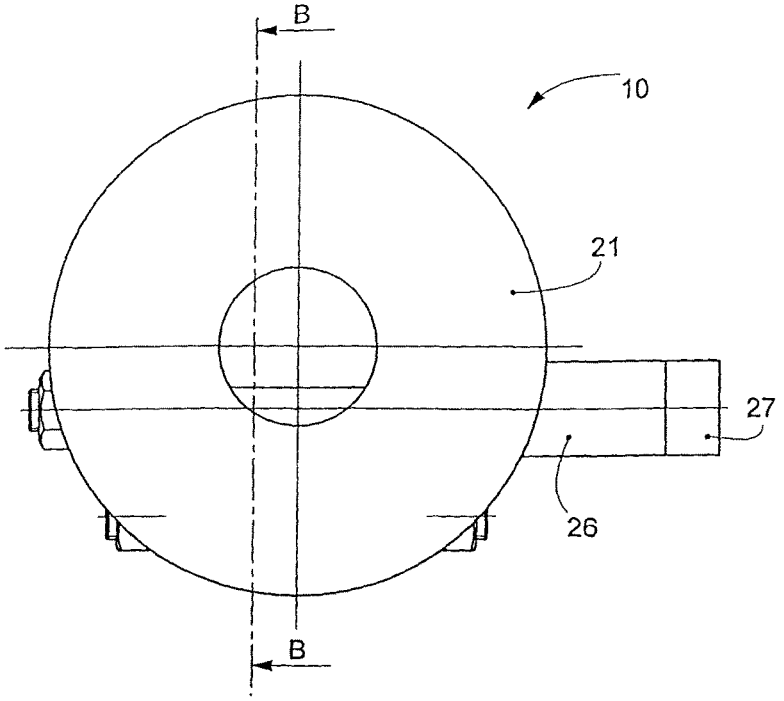
FIG. 5 is a lateral view of the scale-removal device according to the present invention.
Figure 6:
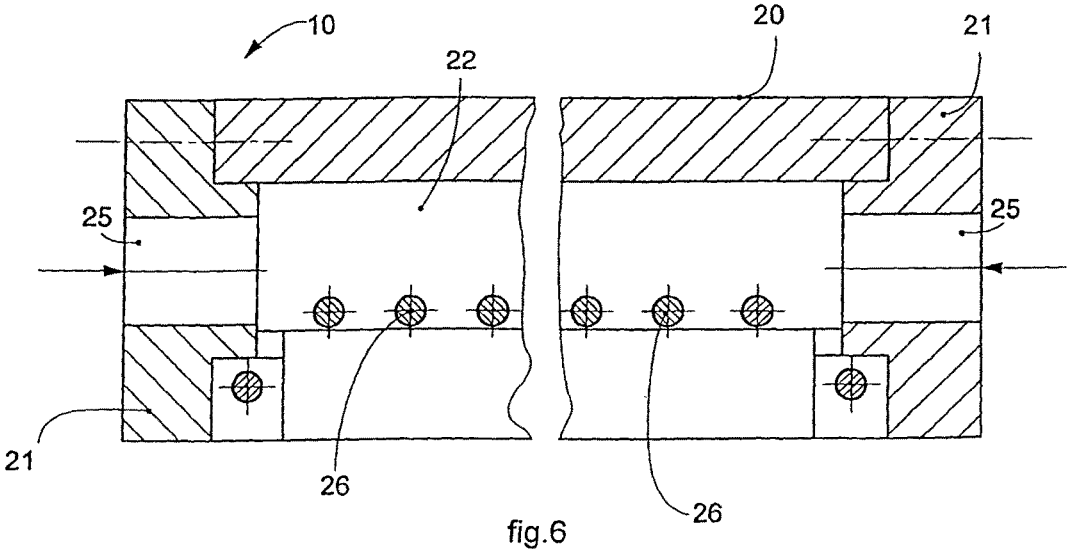
FIG. 6 is the section from B to B of FIG. 5.

In particular, the shape of the two tiles 24, as shown in the enlarged detail in FIG. 4*a*, has an asymptotic converging development determined by the respective converging surfaces 124, which determines a progressive acceleration of the stream of water, and a last segment with a parallel development, determined by the respective parallel surfaces 224, which determines a stabilization of the stream of water. The stabilization part, defined by the parallel walls 224, advantageously has an extension comprised between 5 and 20 times the value of the gap 23 and allows to direct the stream of water in a precise and point-by-point manner in the desired direction, and to prevent the detachment of fluid threads with consequent loss of efficiency and effectiveness of the jet toward the strip 11.

Furthermore, the rounded surfaces of the tiles 24 are advantageously chromed and/or polished on the surface, in order to reduce to a minimum value the sliding friction with respect to the stream of water.

Advantageously, moreover, the tiles 24 are mounted in replaceable manner on the box-like structure 20, so as to allow them to be easily controlled, maintained and/or replaced.

With the above device 10 a blade of water is thus created with a uniform thickness, which hits the surface of the metal product 11 below, for example a strip to be sent for rolling, at high speed and high pressure.

The distance "h" at which the gap 23 is located from the surface of the strip 11 is selected according to requirements but it is assumed to be comprised between 10 and 30 millimeters approximately.

An automatic adjustment mechanism of said distance "h" may be provided, which keeps it at a pre-set optimal value, adjusting the position of the device 10 as the thickness of the strip 11 varies as the rolling passes continue.

The distance "h" can instead be varied according to a table of predefined values as the thickness of the strip 11 varies, in order to maintain at high level the efficiency of the removal of the scale exerted by the blade of water without creating defects in the strip 11 when it assumes a thickness in the range of 2 or 3 millimeters.

The value of the gap 23, which defines the thickness of the blade of water emerging, according to the present invention is less than a millimeter, advantageously in the range of tenths of a millimeter, more advantageously in the range of hundredths of a millimeter.

The exit pressure of the water is at least more than 75 bar, advantageously comprised between 100 and 150 bar which, combined with the limited width of the gap 23 and the speed of feed of the strip 11, which can be comprised between 4 and 10 m/s, determines the emission of a blade of water with an extremely high kinetic energy which removes the scale from the surface of the strip 11 with the water remaining in contact with the surface for a minimum contact time.

This reduced contact time considerably reduces the removal of temperature from the strip 11, so that the treatment does not prejudice the subsequent sending of the strip 11 for rolling.

Applicant has calculated that, using the device according to the present invention, with a speed of feed of the strip in the range of 10 m/s, the water remains on the surface of the strip 11 in the range of about one ten thousandth of a second (according to the measurements made by Applicant), so that the reduction in temperature of the surface of the strip is limited to no more than 1.0-1.5° C., which is an acceptable value for the rolling operations carried out at exit from the scale-removal treatment.

In order to guarantee that the definitive gap value of the gap 23 is maintained, the box-like structure has a plurality of connection and stiffening tie-rods 26, which are disposed transverse to the longitudinal development of the box-like structure 22.

The tie-rods 26 are positioned upstream of the exit zone of the water, that is, upstream of the gap 23, in particular in a low-speed zone of the water, so as not to disturb the stream and to reduce its speed.

Furthermore, the tie-rods 26 have a preferably circular geometry, in this case too to determine as little disturbance as possible to the water.

Each of the tie-rods 26, disposed so as to cover a substantial part but not all of the width of the device 10 (that is, the part of the width that substantially corresponds to the width of the strip 11), is associated with a corresponding position transducer 27 connected to a control unit, not shown.

A desired value of the gap 23 may be set, at start of process, in the control unit, or a table of values corresponding for example to each pass of the strip 11 through the rolling stand 50.

A corresponding actuator 28 is also associated with each tie-rod 26, for example hydraulic or oil-dynamic.

If, through the control unit, the position transducer 27 detects that the gap value of the gap 23 has been modified with respect to the pre-set value, or does not correspond to the programmed variable value (for example because of the pressure exerted by the water on the facing internal walls of the tiles 24, which pressure can be different between the center and lateral ends, or caused by a different abrasion effect of the particles transported by the water), then a command is sent to the actuator 28 corresponding to the tie-rod 26, to restore the correct value.

Since this control is advantageously applied to all the tie-rods 26 distributed on the width that defines the blade of water delivered against the surface of the strip 11, in this way the maintenance of the desired gap value of the gap 23 is ensured even after repeated delivery cycles at high water speed and high water pressure.

The presence of the actuators 28 associated with the tie-rods 26 allows to increase the gap 23 of the exit fissure in order to perform, for example, periodic cycles of water delivery with a larger gap without the strip 11 below, in order to clean the exit fissure of possible impurities and residues.

Furthermore, the actuators 28 can be used to perform an initial setting, in which all the tie-rods 26 are subjected to equal force, after the gap 23 has been closed, a pressure is introduced inside the box-like structure 20 equal to the working pressure of the water, and all the transducers 27 are zeroed, so that they have a common reference and so that the precision and constancy of the 23 are guaranteed over the whole of its width.

The tie-rods 26 can also have an oval section or other suitable for the purpose, advantageously at least partly rounded for the purpose given above.

On the lateral parts of the box-like structure 20 there are two fixed connection and stiffening tie-rods 29, to connect with the head flanges 21.

The orientation of the device 10 with respect to the strip 11 can be such as to dispose the blade of water substantially vertical to the surface of the strip 11 (as can be seen in FIG. 4), or the blade of water can form an angle with respect to the vertical comprised between 5° and 15°, advantageously oriented in counter-flow with respect to the direction of feed of the strip 11.

An automated positioning device (not shown) may be provided for the device 10, which adjusts the distance "h" with respect to the surface of the strip 11, and/or the inclination, in order to vary the angle at which the blade of water hits, in an automated manner and/or according to a predefined table which follows the variation in thickness of the strip 11 as the rolling passes proceed.

Modifications and variants may be made to the present invention, all of which shall come within the field of protection as defined by the following claims.

The invention claimed is:

1. A device for removal of scale from a surface of a metal product by delivering water under pressure, the device comprising:

a box-shaped structure defining an internal space for passage of the water under pressure, and having an exit fissure, the exit fissure having a length, a width, and a gap, the gap having a gap value being less than one millimeter, so that water exiting the gap forms a blade of water extending across a width of the metal product, wherein the exit fissure is defined by adjacent surfaces of two adjacent tiles, the surfaces having a rounded shape, and wherein the device further comprises an adjustment means to adjust the gap value, the adjustment means comprising a plurality of connection and stiffening tie-rods disposed substantially transverse to the gap, each of the tie-rods being connected to a corresponding position transducer and to a corresponding actuator to act on the corresponding tie-rod to restore a correct gap value if the position transducer detects that at least one of the following conditions exists: (a) the gap value is modified with respect to a pre-set value, or (b) the gap value does not correspond to a programmed variable value.

2. The device according to claim 1, wherein the water forms a stream passing through the exit fissure, and the adjacent tiles define a configuration of the exit fissure having a first region where the stream is accelerated, the first region being defined by segments of reciprocally converging walls and a terminal region where the stream is stabilized, the terminal region being defined by segments of reciprocally parallel walls.

3. The device according to claim 1, wherein the gap value between 1 and 10 hundredths of a millimeter.

4. A method to remove scale from a surface of a metal product by delivering water under pressure, the method comprising the following steps:

supplying a device to deliver water under pressure comprising a box-shaped structure defining an internal space for passage of the water under pressure, and having an exit fissure, the exit fissure having a length, a width, and a gap, the gap having a gap value so that water exiting the gap forms a blade of water extending across a width of the metal product;

adjusting the gap value of the exit fissure to a gap value of less than one millimeter by an adjustment means comprising a plurality of tie-rods disposed substantially along the width of the exit fissure, each of the tie-rods being connected to a corresponding actuator and to a position transducer;

positioning the exit fissure at a distance between about 10 and 30 mm from the surface of the product;

feeding water to the internal space of the box-shaped structure at a pressure higher than at least 75 bar, in order to generate an exit speed of the water on an order of 100-150 m/s, the water exiting the gap so that the water forms a blade of water extending across the width of the metal product;

contacting the blade of water with the surface of the metal product to remove scale from the surface;

detecting, via at least one of the position transducers, that at least one of the following conditions exists: (a) a gap value of the exit fissure is modified with respect to a pre-set value, or (b) a gap value of the exit fissure does not correspond to a programmed variable gap value; and restoring a correct gap value with a corresponding actuator on at least one of the tie rods.

5. The method according to claim 4, further comprising a step of setting a position of the transducers, wherein the setting step includes the following steps:

activating the transducers by an equal force completely closing the gap;

introducing a pressure inside the box-shaped structure equal to a working pressure of the water; and zeroing all the transducers to obtain a common reference.

6. The method according to claim 4, further comprising carrying out at least a step of cleaning the exit fissure by widening the exit fissure to have a higher gap value than the gap value used for removal of the scale, and then delivering water through the widened exit fissure.

7. The method according to claim 4, further comprising, during use, adjusting and setting the position of the tie-rods, so as to progressively reduce, at predetermined intervals of time, the gap value of the exit fissure to compensate for wear on the exit fissure.

8. A method to remove scale from a surface of a metal product by delivering water under pressure, the method comprising:

providing a first and a second device, each of the first and second devices comprising:

a box-shaped structure defining an internal space for passage of the water under pressure, and having an exit fissure, the exit fissure having a length, a width, and a gap, the gap having a gap value being less than one millimeter, so that the water exiting the gap forms a blade of water extending across a width of the metal product, wherein the exit fissure is defined by adjacent surfaces of two adjacent tiles, the surfaces having a rounded shape, and wherein the device further comprises an adjustment means to adjust the gap value, the adjustment means comprising a plurality of connection and stiffening tie-rods disposed substantially transverse to the gap, each of the tie-rods being connected to a corresponding position transducer and to a corresponding actuator to act on the corresponding tie-rod to restore a correct gap value if the position transducer detects that at least one of the following conditions exists: (a) the gap value is modified with respect to a pre-set value, or (b) the gap value does not correspond to a programmed variable value;

configuring the first device so that the blade of water is directed towards an upper surface of the metal product;

configuring the second device so that the blade of water is directed towards a lower surface of the metal product, wherein a delivery pressure of the water of the first device is greater than a delivery pressure of the water of the second device; and removing scale from at least one of the upper surface and the lower surface of the metal product by contacting the metal product and the blades of water of the first and second devices.

* * * * *